United States Patent [19]

Kelly

[11] Patent Number: 4,540,444

[45] Date of Patent: Sep. 10, 1985

[54] ALUMINUM CLEANER AND SYSTEM

[75] Inventor: Timm L. Kelly, Oreland, Pa.

[73] Assignee: Amchem Products, Inc., Ambler, Pa.

[21] Appl. No.: 407,611

[22] Filed: Aug. 12, 1982

[51] Int. Cl.[3] ..... C23G 1/14

[52] U.S. Cl. ..... 134/3; 134/29; 134/40

[58] Field of Search ..... 134/28, 29, 3, 40; 252/174.14, 156, 523, 135, 89.1

[56] References Cited

U.S. PATENT DOCUMENTS

| | | | |
|---|---|---|---|
| 3,010,907 | 12/1961 | Carroll | 252/135 |
| 3,039,970 | 6/1962 | Krueger | 252/135 |
| 3,524,817 | 8/1970 | Roy et al. | 134/29 |
| 3,669,893 | 6/1972 | Clarke et al. | 134/29 |
| 3,888,783 | 6/1975 | Rodzewich | 252/135 |
| 4,048,121 | 9/1977 | Chang | 252/174.14 |
| 4,116,853 | 9/1978 | Binns | 252/142 |
| 4,270,957 | 6/1981 | Donakowski et al. | 134/29 |

OTHER PUBLICATIONS

*Soap and Sanitary Chemicals,* Oct. 1952, by Milton A. Lesser, pp. 42–45, 169–171.

William A. Hardwick, Two-Piece Cans: Some Flavor Problems Caused by Manufacturing Materials or Practices, MBAA Technical Quarterly, vol. 15, No. 1, 1978.

*Primary Examiner*—William F. Smith
*Assistant Examiner*—Michael K. Boyer
*Attorney, Agent, or Firm*—Ernest G. Szoke; Henry E. Millson, Jr.; Mark A. Greenfield

[57] ABSTRACT

Processes and alkaline cleaning compositions for cleaning aluminum containers to prevent off-flavor and off-taste in liquid comestible products with which the containers are filled. The processes involve the use of an aqueous alkaline cleaning solution having the following compositions:

| Ingredient | Quantity, g/l |
|---|---|
| 1. Alkali metal or ammonium carbonate | 0.1–0.9 |
| 2. Alkali metal or ammonium tripolyphosphate (anhydrous) | 0.6–7.6 |
| 3. Alkali metal or ammonium tetraborate (pentahydrate) | 0.5–6.3 |
| 4. Alkali metal or ammonium metasilicate (anhydrous) | 0.1–0.8 |
| 5. Tri(alkali metal or ammonium)phosphate (anhydrous) | 0.4–5.4 |
| 6. Alkali metal or ammonium gluconate or glucoheptonate | 0.1–1.3 |
| 7. Surfactant | 0.02–0.27 |

6 Claims, No Drawings

ALUMINUM CLEANER AND SYSTEM

BACKGROUND OF THE INVENTION

In the manufacture of aluminum and aluminum alloy containers, container manufacturers purchase long rolls of sheet aluminum from aluminum companies as the raw material for the manufacture of the containers. In order to prevent abrasion of the surfaces of these aluminum sheets, so-called "rolling oils" are applied to the surfaces thereof prior to rolling the sheets for shipment to the container manufacturers. The container manufacturers then use the sheet aluminum in drawing and forming operations, usually referred to as "drawing and ironing" to form the aluminum containers. In these drawing and ironing operations lubricants and forming oils are used on the surfaces of the aluminum to facilitate these operations.

In order to remove the rolling oils, lubricants and forming oils, as well as aluminum fines, all of which are usually present on the inner and outer surfaces of the aluminum containers, cleaning operations must be employed prior to further processing of the containers. Present commercial container lines typically utilize the following basic steps: prewash→acid cleaning→tap water rinse→conversion coating→tap water rinse→deionized water rinse. Following this cleaning and surface treatment sequence, the containers are dried and are then suitable for further processing, including the application of siccative coatings and labeling inks.

One of the largest uses of these aluminum containers is for liquid comestibles, such as beer, soft drinks, etc. During the past five years or so, occasional problems have arisen with off-flavor and off-taste, particularly with beer. This problem appears to be aggravated by periods of storage of the filled containers prior to consumption. After intensive study of the problem by brewers, can manufacturers, consulting firms, and manufacturers of aluminum cleaning products, it was determined that the problem was caused, at least in part, by the presence of minute quantities of $C_7$, $C_8$ and/or $C_9$ unsaturated aldehydes in the beer. Such aldehydes are particularly strong flavorants. For example, 2-nonenal is detectible in beer at a level of one part per billion (ppb) and is objectionable at a level of 2 parts per billion. These aldehydes are formed from the oxidation of unsaturated fatty acids such as oleic, linoleic, and linolenic acid, one or more of which unsaturated fatty acids are usually present in the rolling oils, lubricants, and/or forming oils used in processing the aluminum containers. A good discussion of this problem is given in an article entitled "Two-Piece Cans: Some Flavor Problems Caused by Manufacturing Materials or Practices", by William A. Hardwick, MBAA Technical Quarterly, Vol. 15, No. 1, 1978.

Attempts to eliminate this taste problem (commonly referred to as the "labox" problem) in beer have not to date been uniformly successful. For example, aluminum container manufacturers have not been successful in totally eliminating the presence of unsaturated fatty acids from their lubricants and forming oils. Also, efforts by manufacturers of aluminum cleaning products have not heretofore been able to devise a cleaning system that results in complete removal of unsaturated fatty acids from the surfaces of the aluminum containers and the labox problem has not been solved to date in any consistently satisfactory manner.

DETAILED DESCRIPTION OF THE INVENTION

There has now been discovered an alkaline cleaning bath which, when used to clean the surfaces of the aluminum containers subsequent to the acid cleaning step, eliminates the labox problem and the beer taste problems associated therewith. While it is believed that the novel alkaline cleaning baths and processes of the invention eliminate the labox problem by the complete removal of unsaturated fatty acids from the aluminum surfaces, other explanations may be discovered for the surprising results obtained, and the invention in not limited to any particular mechanism of action.

The cleaning sequence of the invention can be carried out with aluminum or aluminum alloy contaiers as follows: prewash→acid cleaning→tap water rinse→alkaline cleaning→tap water rinse→conversion coating→tap water rinse→deionized water rinse.

Alternatively, the process can also be carried out without use of a conversion coating as follows: prewash→acid cleaning→tap water rinse→alkaline cleaning→tap water rinse→deionized water rinse. While one or more of the prewash and tap water rinse steps may be eliminated from the above process sequences, such steps are much preferred for commercial use since otherwise the cleaning and conversion coating baths will become rapidly contaminated and require frequent and expensive replacement.

The containers that can be cleaned by the compositions and processes of the invention include those made of aluminum and aluminum alloys in which aluminum is the principal constituent.

The novel alkaline cleaning bath of the invention is an aqueous solution containing the following ingredients and quantities thereof:

Alkaline Cleaning Bath

| Ingredient | Quantity, g/l | Preferred Quantity, g/l |
|---|---|---|
| 1. Alkali metal or ammonium carbonate | 0.1–0.9 | 0.2–0.6 |
| 2. Alkali metal or ammonium tripolyphosphate (anhydrous) | 0.6–7.6 | 2.0–5.1 |
| 3. Alkali metal or ammonium tetraborate (pentahydrate) | 0.5–6.3 | 1.7–4.2 |
| 4. Alkali metal or ammonium metasilicate (anhydrous) | 0.1–0.8 | 0.2–0.5 |
| 5. Tri(alkali (alkali metal or ammonium) phosphate (anhydrous) | 0.4–5.4 | 1.4–3.6 |
| 6. Alkali metal or ammonium gluconate or glucoheptonate | 0.1–1.3 | 0.3–0.9 |
| 7. Surfactant | 0.02–0.27 | 0.07–0.18 |

The alkaline cleaning bath is preferably made up by dissolving in water a suitable quantity of a solid mixture of the above ingredients, preferably in homogeneous powder form, and this solid composition comprises one aspect of the present invention. This solid composition is composed of the above ingredients in the parts by weight ratio of ingredients given below:

Solid Composition

| Ingredient | Parts by weight | Preferred Parts by weight |
|---|---|---|
| 1. Alkali metal or ammonium carbonate | 1 | 1 |

-continued

| Solid Composition | | |
|---|---|---|
| Ingredient | Parts by weight | Preferred Parts by weight |
| 2. Alkali metal or ammonium tripolyphosphate (anhydrous) | 0.67–67 | 3.3–25.5 |
| 3. Alkali metal or ammonium tetraborate (pentahydrate) | 0.55–63 | 2.8–21 |
| 4. Alkali metal or ammonium metasilicate (anhydrous) | 0.11–8 | 0.33–2.5 |
| 5. Tri(alkali metal or ammonium) phosphate (anhydrous) | 0.44–54 | 2.33–18 |
| 6. Alkali metal or ammonium gluconate or glucoheptonate | 0.11–13 | 0.5–4.5 |
| 7. Surfactant | 0.02–2.7 | 0.12–0.9 |

In addition to the solid composition given above, the alkaline cleaning baths of the invention may also be formed by appropriate dilution of an aqueous concentrate containing the ingredients present in the bath in more concentrated form. In such aqueous concentrate, the ingredients are present in the same weight ratio as in the solid composition.

In the above composition, aqueous concentrate, and cleaning bath, ingredients 1, 2, 3, 4, 5 and 6 used therein can be in the form of the ammonium salt or in the form of an alkali metal salt, e.g. sodium or potassium salt, with the sodium salt preferred, e.g. ingredient 1 is preferably sodium carbonate, ingredient 5 is preferably trisodium phosphate (anhydrous), ingredient 6 is preferably sodium gluconate and/or sodium glucoheptonate, etc. Obviously a mixture of alkali metal salts or an alkali metal salt plus an ammonium salt, in any proportion, can also be used for any ingredient 1 through 6. While ingredient 3 is given as the pentahydrate, the anhydrous form or another hydrate can equally well be employed here, with the grams per liter and parts by weight adjusted accordingly for the differences in water of hydration. Similarly, the anhydrous ingredients 2, 4, and 5 can be added as a hydrate, with quantities thereof adjusted to take into account the weight of the water of hydration. However, when one or more of such ingredients are added in hydrate form, caking of the composition may occur; hence use of the anhydrous ingredients is preferred in the practice of the invention. Ingredient 7 is a surfactant or combination of surfactants which is or are stable in the solid compositions, liquid concentrates and alkaline cleaning baths of the invention. The surfactant or combination or surfactants is preferably a low foaming surfactant or combination of such low foaming surfactants. By "low foaming" is meant a surfactant or combination of surfactants that gives less than 20 mm. of foam after five minutes standing in the well known Ross-Miles Foam Test at 50° C. (ASTM D-1173-63). The surfactant or combinations thereof that can be used in the practice of the invention include nonionic, anionic, and cationic surfactants. Examples of the preferred low foaming surfactants that can be used alone or in combination in the practice of the invention include the following:

TRITON DF-16 (Rohm & Haas Co.) a nonionic surfactant believed to be a modified polyethoxylated straight chain alcohol;

POLYTERGENT S-505 LF (Olin Corp.) a nonionic surfactant believed to be modified polyethoxylated straight chain alcohol;

SURFONIC LF-17 (Jefferson Chemical Co.) a nonionic surfactant believed to be an alkyl polyethoxylated ether;

ANTAROX BL 330 (GAF Corp.) a nonionic surfactant believed to be an alkyl poly (ethyleneoxy) ethanol;

TRITON CF-10 (Rohm & Haas Co.) a nonionic surfactant, and believed to be an alkylaryl polyether having a carbon chain of about 14 carbon atoms and approximately 16 moles of ethoxylation;

PLURONIC L061 (BASF Wyandotte, Inc.) a nonionic surfactant, and believed to be a condensate containing only ethylene oxide and propylene oxide chains;

ANTAROX LF-330 (BAF Corp.) a nonionic surfactant, believed to be an alkyl poly(ethyleneoxy) ethanol;

MIN-FOAM 1X (Union Carbide Corp.) a nonionic surfactant believed to be alkyloxy(polyethyleneoxypropyleneoxyisopropanol) having a molecular weight of about 706.

MIRAWET B (Miranol Chemical Co.) an anionic surfactant which is sodium 2-butoxyethoxyacetate.

The process of the invention is carried out by first prewashing the aluminum containers which are contaminated with rolling oils, lubricants, forming oils and aluminum fines. The prewashed containers are then treated by immersion in or spraying with an acid cleaning solution known to the art, e.g. utilizing the compositions and procedures of U.S. Pat. No. 4,116,853, issued Sept. 26, 1978 to Robert Eric Binns. The acid cleaned containers are then rinsed with tap water and treated with an alkaline cleaning bath of the invention using spray equipment standard in the field, or by immersing the containers in the bath. Treatment times are of the order of from about 5 seconds to about one minute, preferably from about 10 seconds to about 30 seconds. Treatment temperatures are from about 90° F. to about 130° F., preferably from about 100° F. to about 115° F.

The containers are then rinsed with tap water to remove residual alkaline cleaning solution, and then either rinsed with deionized water and dried for further processing or treated with a conversion coating solution in a manner well known to the art, followed by a tap water rinse and a deionized water rinse. The containers are then dried and are ready for further processing such as by treatment with a siccative finish coating composition.

The invention will be illustrated by the following examples which are not given for purposes of limitation.

EXAMPLE I 400 cans of aluminum 3004 alloy drawn into single piece containers from an aluminum coil produced by the Aluminum Company of America and coated with drawing oils, rolling oils, and lubricants known to cause labox problems are used in the following procedure:

| Stage | Spray Treatment | Treatment Temp. (°F.) | Spray Press. (psi) | Spray Time (sec.) |
|---|---|---|---|---|
| 1. Prerinse | Tap water | — | 12.5 | — |
| 2. Prewash | 0.5% Acid Composition* | 125 | 30 | 25 |
| 3. Acid clean | 1.8% Acid Composition* and 64 mg/l HF | 130 | 30 | 50 |
| 4. Rinse | Recirculated tap water | — | 10 | — |
| | Fresh water | — | 10 | — |
| 5. Alkaline clean | 12.0 g/l of Alkaline Composition** | 110 | 7.5 | 18.5 |

-continued

| Stage | Spray Treatment | Treatment Temp. (°F.) | Spray Press. (psi) | Spray Time (sec.) |
|---|---|---|---|---|
| 6. Rinse | Recirculated tap water | — | 10 | — |
| | Fresh tap water | — | 10 | — |
| 7. Deionized water rinse | Recirculated DI water | — | 10 | — |
| | Fresh DI water | — | 10 | — |
| 8. Oven dry | — | 400 | — | 240 |

*Acid Composition is aqueous solution of 410 g/l of $H_2SO_4$ and 66 g/l of TRITON DF 16.

**Alkaline Composition is a powdered solid composition containing the following ingredients in the following percentages by weight:

| Ingredient | % by weight |
|---|---|
| Sodium carbonate | 4.0 |
| Sodium tripolyphosphate | 33.7 |
| Borax pentahydrate | 28.0 |
| Sodium metasilicate | 3.5 |
| Trisodium phosphate (anhyd.) | 23.7 |
| Sodium gluconate | 5.9 |
| SURFONIC LF 17 | 1.2 |

The cans processed as above are then coated with Glidden 549A640C, a water borne lacquer, and filled with beer and capped on a commercial beer filling line. Ths cans are stored at 85° F. temperature for 1 month and the contents of each can tested by panels of expert tasters. None of the beer had any detectible sign of off-flavor or off-taste.

EXAMPLE II 400 cans are processed according to the cleaning procedure of EXAMPLE I except that stages 5 and 6 are omitted during the cleaning process. The cans are then coated with Glidden 549A640C, a water borne lacquer, filled with beer and capped using the same commercial beer filling line as in EXAMPLE I. The cans are stored at 85° F. temperature for 1 month and the contents tasted by the same panels of expert tasters. Substantially all of the cans contained beer having an off-flavor and off-taste according to the consensus of the panels.

What is claimed is:

1. In a method for cleaning aluminum or aluminum alloy beverage containers comprising the use of an acid cleaning bath, the improvement comprising treating the containers subsequent to the acid cleaning bath with an alkaline cleaning solution for from about 5 seconds to about 1 minute at a temperature in the range of from about 90° F. to about 130° F. to remove trace impurities including $C_7$–$C_9$ aldehydes that cause off-flavor in beverages, wherein said alkaline cleaning solution consists essentially of:

(a) from about 0.2 to about 0.6 g/l of at least one alkali metal or ammonium carbonate;

(b) from about 2.0 to about 5.1 g/l of at least one alkali metal or ammonium tripolyphosphate;

(c) from about 1.7 to about 4.2 g/l of at least one alkali metal or ammonium tetraborate pentahydrate;

(d) from about 0.2 to about 0.5 g/l of at least one alkali metal or ammonium metasilicate;

(e) from about 1.4 to about 3.6 g/l of at least one tri(alkali metal or ammonium) phosphate;

(f) from about 0.3 to about 0.9 g/l of at least one alkali metal or ammonium gluconate or glucoheptonate; and (g) from about 0.02 to about 0.27 g/l of at least one surfactant which is stable in the aqueous alkaline solution.

2. A method according to claim 1 wherein the temperature is in the range of from about 100° F. to about 115° F.

3. A method in accordance with claim 1 wherein said time is from about 10 seconds to about 30 seconds.

4. A method in accordance with any one of claims 1, 2, or 3 wherein the containers are treated by spraying the alkaline cleaning solution onto the surfaces thereof.

5. A method in accordance with claim 1 wherein the surfactant (g) is at least one low foaming surfactant.

6. In a method for cleaning aluminum or aluminum alloy beverage containers comprising the steps of prerinse; acid prewash; acid clean; rinse; and deionized water rinse, the improvement comprising adding the following steps between the rinse and deionized water rinse steps to remove trace impurities including $C_7$–$C_9$ aldehydes that cause off-flavor in beverages:

A. spraying said containers with an alkaline cleaning solution for from about 5 seconds to about 1 minute at a temperature in the range of from about 90° F. to about 130° F., wherein the alkaline solution consists essentially of (a) from about 0.2 to about 0.6 g/l of at least one alkali metal or ammonium carbonate;

(b) from about 2.0 to about 5.1 g/l of at least one alkali metal or ammonium tripolyphosphate;

(c) from about 1.7 to about 4.2 g/l of at least one alkali metal or ammonium tetraborate pentahydrate;

(d) from about 0.2 to about 0.5 g/l of at least one alkali metal or ammonium metasilicate;

(e) from about 1.4 to about 3.6 g/l of at least one tri(alkali metal or ammonium) phosphate;

(f) from about 0.3 to about 0.9 g/l of at least one alkali metal or ammonium gluconate or glucoheptonate; and (g) from about 0.02 to about 0.27 g/l of at least one surfactant which is stable in the aqueous alkaline solution; and B. rinsing the containers with water.

* * * * *